US005168581A

United States Patent [19]

Garcia et al.

[11] Patent Number: 5,168,581

[45] Date of Patent: Dec. 8, 1992

[54] WAISTBAND CONSTRUCTION FOR PANTS

[75] Inventors: Fernand Garcia, Aussonne; Bruno Le Cottier; Philippe Jougla, both of Toulouse, all of France

[73] Assignee: S.A. Generale du Pret a Porter, Portet sur Garonne, France

[21] Appl. No.: 706,928

[22] Filed: May 30, 1991

[51] Int. Cl.[5] ..... A41D 1/06

[52] U.S. Cl. ..... 2/237; 2/236; 2/220; 2/221

[58] Field of Search ..... 2/237, 236, 220, 221

[56] References Cited

U.S. PATENT DOCUMENTS

| | | | |
|---|---|---|---|
| 3,663,963 | 5/1972 | Miller | 2/237 |
| 3,723,993 | 4/1973 | Ruby | 2/237 |
| 3,869,728 | 3/1975 | Spencer | 2/237 |
| 4,332,034 | 6/1982 | Muse | 2/237 |
| 4,549,317 | 10/1985 | D'Ambrosio | 2/237 |
| 4,970,728 | 11/1990 | D'Ambrosio | 2/237 |

*Primary Examiner*—Werner H. Schroeder
*Assistant Examiner*—Gloria Hale
*Attorney, Agent, or Firm*—Harold H. Dutton, Jr.

[57] ABSTRACT

The invention relates to a pants belt of the "English belt" type sewn into the upper part of a pair of extensible pants. This belt comprises an elastic band (3) of which the inner face is covered with upper (6) and lower (7) sheaths, composed of bands of bias fabric obtained by weaving non-extensible threads and cutting on a bias. The lower lining (7) comprises a floating part (*7a*) which may be connected to the pocket sacks by attaching points (12). The belt of the invention combines high aesthetic qualities, inside and outside, permitting mounting it on high quality pants, with remarkable qualities of elasticity, remanence and tension.

6 Claims, 2 Drawing Sheets

WAISTBAND CONSTRUCTION FOR PANTS

This invention relates to a pants belt of the type known as an "English belt" which is sewed into the top part of an expansible pair of pants.

BACKGROUND AND OBJECTS OF THE INVENTION

With the goal of increasing their comfort, many pants are produced of an extendible fabric, and they must preferably be provided at the waistband with an extendible belt, avoiding a blocking which would cause them to lose their comfort. Many types of extensible English belts are known. These belts comprise generally an elastic band (a type of rubber band) which gives them their longitudinally extensible quality (see for example French patent 2,196,130). However, this band induces a very inaesthetic aspect to the upper part of the pants. To increase the aesthetic qualities, it has been proposed to envelope the elastic band in a tubular sheath which hides it from view. One can review, for example, the following patents which relate to such belts: French patents 2,202,660 and 2,355,470; U.S. Pat. Nos. 22,438,804 and 3,761,966.

The present invention proposes to improve existing belts of the above mentioned type. It seeks to provide an extendible English belt which associates the following qualities:

good elasticity of the belt, permitting full benefit of the extensible qualities of the pants;

satisfactory remanence and tension assuring a correct supporting of the pants;

traditional appearance, range of height, both on the inside and on the outside of the belt.

DESCRIPTION OF THE INVENTION

To this end, the English belt for pants according to the invention, arranged in the upper part of the extensible pants, is of the type comprising an elastic band, a band of fabric called the outer band, preferably of the same material as the pants, extending on the outer face of the band and overlapping the upper edge thereof by a fold, a first extensible seam called the lower seam, fastening the upper part of the pants, the outer band and the elastic band. According to the present invention, said belt is characterized in that:

the internal face of the elastic band is covered with two bands of fabric, of the bias band type, made from non-extendible woven fabric and cut on a bias, conferring on said bands a longitudinal extensibility, these bias bands, called upper and lower linings, form opposing folds which are covered and sewn onto the elastic band at their covered edges by means of a second extensible seam, called a median seam, not affecting the outer band, the upper lining is sewn along its upper part to the elastic band by a third extensible seam, called the upper seam, traversing the internal fold of the outer band, the lower lining comprises a floating part extending beneath the lower edge of the elastic band.

The characteristics hereinabove mentioned are combined to confer on the belt of the invention the attractive appearance of a high belt of a traditional range, a remarkable longitudinal elasticity permitting easily permitting achieving a size of pants cut from an appropriate extensible fabric, and a remanence and tension assuring good support and a return to the initial size regardless of the length of wear.

BRIEF DESCRIPTION OF THE DRAWINGS

Other characteristics, objects and advantages of the invention will become apparent from the description which follows with reference to the accompanying drawings which form an integral part of the present description.

DESCRIPTION OF PREFERRED EMBODIMENTS

Figure 1:
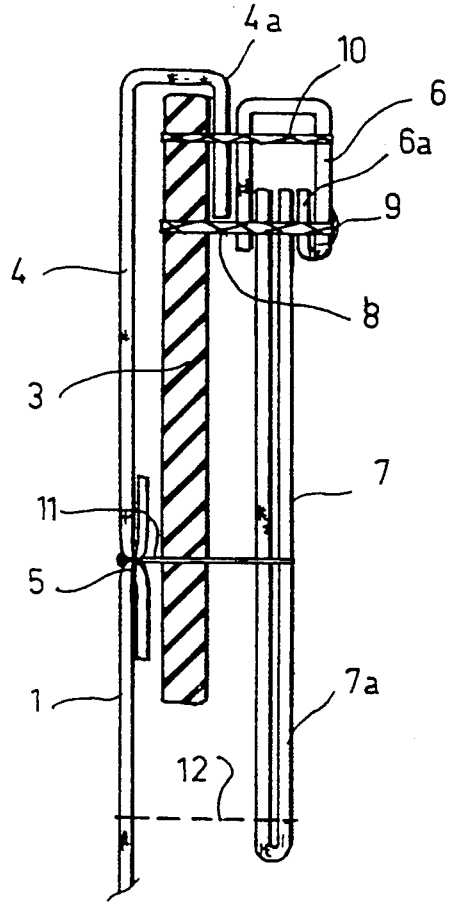
FIG. 1 is a schematic view in cross-section of a belt according to the invention (the thicknesses having been exaggerated to make the drawing more clear)

The English belt shown by way of example in the drawings is mounted on a pair of bi-extensible pants which are partially shown as 1 in these drawings. These pants are produced in a conventional manner from a fabric of cotton, wool or polyester/wool blend, integrating a percentage of "elasticity" which confers on them an extensibility in two directions. These pants comprise pockets which have been shown schematically on the right side at 2*a* in FIG. 3 and inside out at 2*b* in FIG. 2 (pocket sacks).

The English belt provided by the invention comprises an elastic band 3 which may in particular be made of a strip woven from a wrapped elastic warp thread and a non-elastic weft thread. The warp thread is preferably a thread of rubber wound with a thread of polyester and mixed with a polyamide foam. The elastic band 3 has an longitudinal elasticity on the order of 100% in the aforementioned example.

The outer face of the elastic band 3 (the right side of the pants) is provided with a band of fabric 4 called the outer band, of the same material as the pants. This outer band 4 overlaps the upper edge of the band by a fold 4*a* which goes down over a small portion of the height of said band. On the right side, the legs of the pants 1 are initially sewn to the outer band 4 by an extensible seam with small chain stitches 5 made with a thread having a high degree of extensibility.

The internal face of the elastic band 3 is covered with two strips of fabric, called the upper lining 6 and the lower lining 7. These linings or bands are bias bands produced by weaving non-extendible threads and cutting them on a bias. In the example, these bands are cut on a bias into a chevron fabric and the chevrons are seen at 6*a* or 7*a* in FIG. 2. The threads used for producing these bias bands are for example threads of 70% cotton, 30% polyester. Such bands have a longitudinal extensibility comprising between 15% and 30%, in particular on the order of 20%.

The upper lining 6 and the lower lining 7, made by means of the bias bands, are arranged to form two opposing folds which fold back on each other as shown in FIG. 1. They are sewn to the elastic band 3 by means of an extensible seam 8 called a median seam, which traverses the band and the edges of the back fold of the sheaths, without affecting the outer band 4. This seam 8 is a zig-zag stitch seam made with a thread having a high percentage of elasticity. From the inner side, the visible part of this median seam may be provided with non-skid points such as 9 in order to limit the transverse sliding of the belt. Further, the edge 6*a* of the upper lining 6 is preferably folded (from the inner side shown) to improve the aesthetics.

The upper lining 6 is sewn in the upper part to the elastic band 3 by an upper extensible seam 10, traversing the inner fold 4*a* of the outer band 4. This seam 6 is a seam produced from zigzag stitches by means of a thread having a high percentage of extensibility.

The lower lining 7 comprises a floating part 7*a* which extends beneath the lower edge of the elastic band.

A lower extensible seam 11 is produced at the level of the small chain seam 5 (between pants 1 and the outer band 4) and fixes these elements to the elastic band. This lower seam 11 is preferably executed with knitted stitches by means of a thread having a high percentage of extensibility. As shown in FIGURE 1, it may be produced in such a manner as to traverse the lower lining 7 in order to stabilize it in the vicinity of the lower edge of the elastic band 3. It is also possible in certain cases to leave the lining 7 completely floating, the seam 11 not affecting this sheath.

Figure 2:
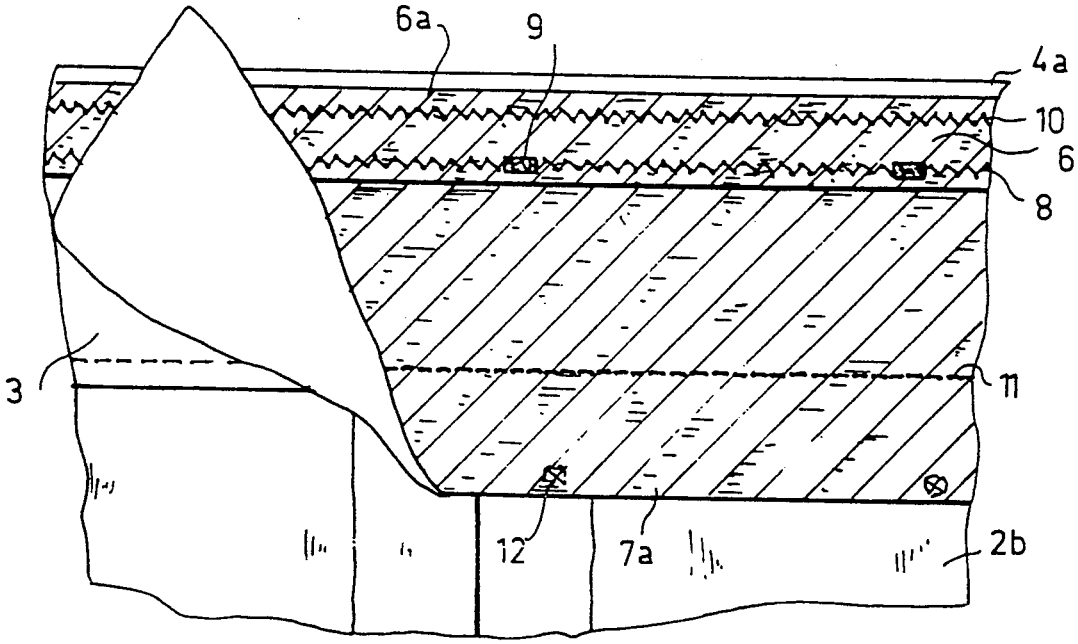
FIG. 2 is a schematic view of the inner side of the belt, a portion of the floating part having been broken away to show the elastic band.
Figure 3:
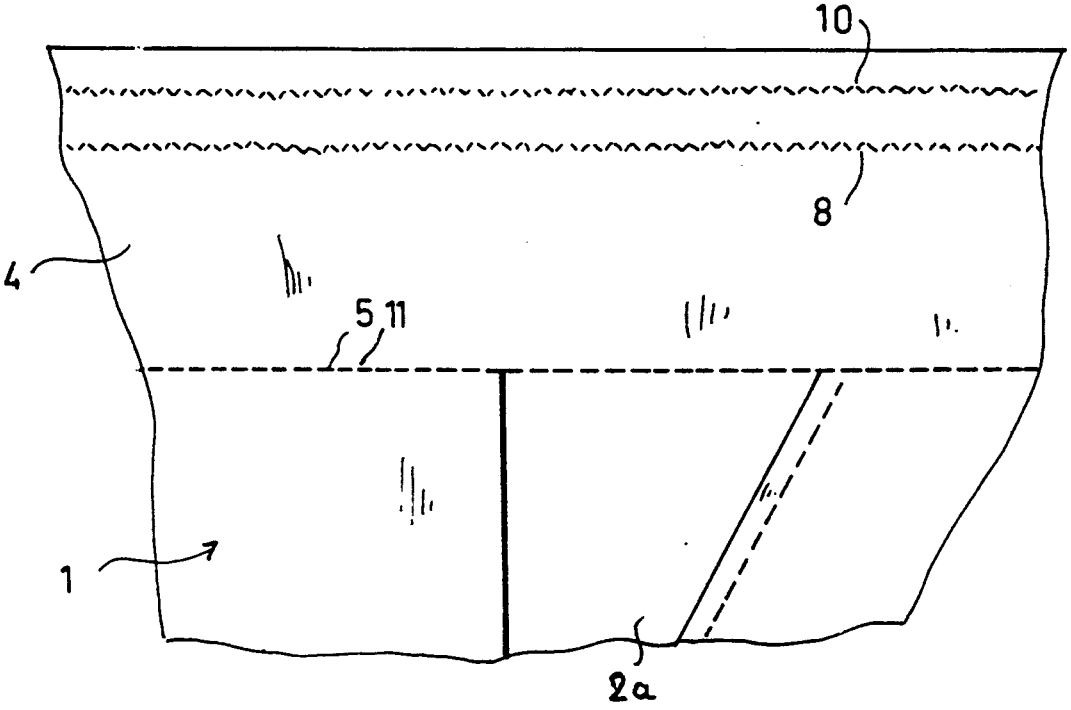
FIG. 3 is a schematic view of the external side of the belt, the upper and median seams not visible, being shown in dotted lines.

In the lower part, the floating part 7*a* of the lower lining is preferably connected to the pocket sacks 2*b* by attaching points shown symbolically at 12 in FIGS. 1 and 2.

Figure 4:
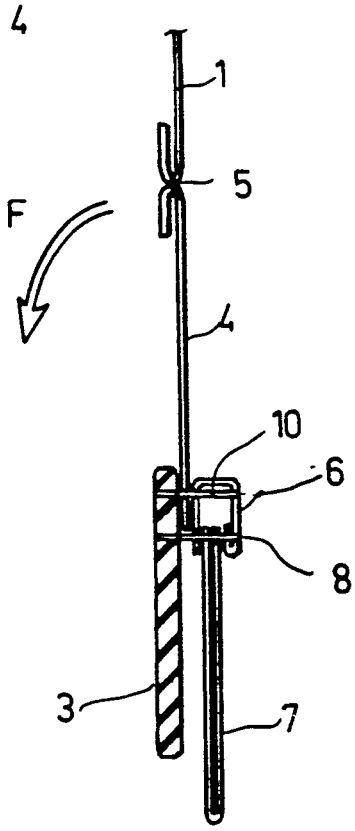
FIG. 4 illustrates the process for attaching the belt to the upper part of the pants.

FIG. 4 shows the mounting of the English belt according to the invention on the pants 1. After making the chain seam 5 securing the legs and the outer band 4, these elements are arranged flat and the edge of the band 4 is inserted between the band 3 and the upper lining 6 until coming to rest against median seam 8 of the belt. The upper seam 10 is then produced, then the band 4 and the pants 1 are turned down with respect to the belt (arrow F). The lower seam 11 may then be executed, the attaching points with the pocket sacks being then produced.

All the seams are carried out by means of a thread having a high percentage of extensibility, for example an extensible thread of long fiber polyester, conferring on said seams a longitudinal extensibility on the order of 20%.

The English belt according to the invention combines high aesthetic qualities, inside and outside, permitting mounting on upscale pants, with remarkable qualities of elasticity, remanence and tension.

We claim:

1. A waistband for pants including a belt sewn into an upper part of pants, comprising an elastic band having an outer face, an outer band of fabric extending over the outer face of the elastic band and covering an upper edge thereof by a fold, a first extensible lower seam securing the pants, the outer band and the elastic band, said elastic band having an internal face covered with two strips of a bias band fabric of woven non-extendible threads and cut on a bias thereby conferring on said bands a longitudinal extensibility, said bias bands forming an upper lining and a lower lining folded back upon each other and sewn onto the elastic band at their edges by means of a second extensible, the upper lining being sewn into the elastic band by a third extensible seam comprising an upper seam traversing the outer band, said lower lining comprising a floating portion extending beneath the lower edge of the elastic band.

2. A belt as in claim 1 comprises a strip woven of an elastic thread of wrapped chains and a non-elastic weft thread, conferring thereon a longitudinal elasticity comprising between 50% and 200%, the upper and lower linings comprising bands woven of cotton or polyester/cotton blends and cut on a bias, in such a manner as to confer thereon a longitudinal extensibility comprising between 15% and 30%, said lower, median and upper seams being made with a thread having a high percentage of extensibility with zig-zap or knit stitches.

3. A belt as in claim 1 and wherein said pants are initially sewn to the outer band by an extensible seam of small chain stitches, the lower seam being at the level of said seam of chain stitches.

4. A belt as in claim 1 and wherein said lower seam traverses the lower lining.

5. A belt as in claim 1 and positioned on the upper portion of a pair of pants having pockets a portion of the lower lining is connected to the pockets by attaching points.

6. A belt as in claim 1 includes non-skid points on the inner portion.

* * * * *